US011986064B2

(12) United States Patent
Kawabata et al.

(10) Patent No.: US 11,986,064 B2
(45) Date of Patent: May 21, 2024

(54) CONDUCTIVE SURFACE FASTENER AND PRODUCTION METHOD THEREFOR

(71) Applicant: KURARAY FASTENING CO., LTD., Osaka (JP)

(72) Inventors: Kouichi Kawabata, Osaka (JP); Makoto Sagara, Sakai (JP)

(73) Assignee: KURARAY FASTENING CO., LTD., Osaka (JP)

( * ) Notice: Subject to any disclaimer, the term of this patent is extended or adjusted under 35 U.S.C. 154(b) by 798 days.

(21) Appl. No.: 17/055,031

(22) PCT Filed: Apr. 5, 2019

(86) PCT No.: PCT/JP2019/015194

§ 371 (c)(1),
(2) Date: Nov. 12, 2020

(87) PCT Pub. No.: WO2019/220809

PCT Pub. Date: Nov. 21, 2019

(65) Prior Publication Data

US 2021/0219669 A1 Jul. 22, 2021

(30) Foreign Application Priority Data

May 17, 2018 (JP) ..... 2018-095155
Jun. 21, 2018 (JP) ..... 2018-117598
Oct. 5, 2018 (JP) ..... 2018-190451

(51) Int. Cl.
*A44B 18/00* (2006.01)
*D04B 21/02* (2006.01)

(52) U.S. Cl.
CPC ..... *A44B 18/0034* (2013.01); *D04B 21/02* (2013.01); *D10B 2501/063* (2013.01)

(58) Field of Classification Search
CPC A44B 18/0034; A44B 18/0023; D04B 21/02; D10B 2501/063; A41D 1/005; A41D 2300/32
See application file for complete search history.

(56) References Cited

U.S. PATENT DOCUMENTS 4,715,235 A * 12/1987 Fukui ..... G01D 5/16 600/595
2004/0074071 A1 4/2004 Golden et al.
(Continued)

FOREIGN PATENT DOCUMENTS

JP 1-74808 U 5/1989
JP 3-261 405 A 11/1991
(Continued)

OTHER PUBLICATIONS

International Search Report dated Jul. 9, 2019 in PCT/JP2019/015194 filed on Apr. 5, 2019, 2 pages.
(Continued)

*Primary Examiner* — David M Upchurch
(74) *Attorney, Agent, or Firm* — Oblon, McClelland, Maier & Neustadt, L.L.P.

(57) ABSTRACT

A conductive hook-and-loop fastener that has a high engagement force, undergoes less decrease in conductivity even after repeated engagement and release, and is significantly flexible. The conductive hook-and-loop fastener includes a base cloth containing a woven fabric, having existing on one surface thereof plural loop engagement elements including a multifilament yarn including as at least a part thereof a conductive filament, and the multifilament yarn constituting the loop engagement elements is inwoven in a warp direction of the woven fabric.

17 Claims, 2 Drawing Sheets

(56) References Cited

U.S. PATENT DOCUMENTS

| | | | | |
|---|---|---|---|---|
| 2005/0061802 | A1* | 3/2005 | Rock | D04B 1/04 219/545 |
| 2016/0106185 | A1* | 4/2016 | Poulakis | A44B 18/0023 15/228 |
| 2018/0195218 | A1* | 7/2018 | Hamada | D04B 27/32 |
| 2019/0208862 | A1* | 7/2019 | Poegl | A43B 23/042 |

FOREIGN PATENT DOCUMENTS

| | | | |
|---|---|---|---|
| JP | 7-194414 | A | 8/1995 |
| JP | 2006-325939 | A | 12/2006 |
| JP | 3174398 | U | 3/2012 |
| JP | 2012-526566 | A | 11/2012 |
| JP | 2015-62600 | A | 4/2015 |
| JP | 2015-109172 | A | 6/2015 |
| JP | 2016-13281 | A | 1/2016 |
| JP | 3209693 | U | 4/2017 |
| KR | 10-2008-0071299 | A | 8/2008 |
| WO | WO 2007-088897 | A1 | 8/2007 |

OTHER PUBLICATIONS

International Search Report issued on Jul. 9, 2019 in PCT/JP2019/015194 filed on Apr. 5, 2019, citing documents AQ-AV therein, 2 pages.

* cited by examiner

CONDUCTIVE SURFACE FASTENER AND PRODUCTION METHOD THEREFOR

TECHNICAL FIELD

The present invention relates to a conductive hook-and-loop fastener that has a high engagement force, undergoes less decrease in conductivity even after repeated engagement and release, is significantly flexible, and furthermore is excellent in aesthetics, and a method for producing the same.

The present invention also relates to a conductive hook-and-loop fastener, particularly a conductive woven fabric hook-and-loop fastener, in which in the case where the hook-and-loop fasteners are overlapped and engaged through engagement element surfaces thereof, the back surface of one of the hook-and-loop fasteners and the back surface of the other of the hook-and-loop fasteners are electrically conducted to each other, that has a high engagement force, undergoes less decrease in conductivity even after repeated engagement and release, is significantly flexible, and furthermore is excellent in aesthetics, and a method for producing the same.

BACKGROUND ART

As a bonding material that can readily perform engagement and release and can be used repeatedly, a combination of a hook-and-loop fastener having hook engagement elements on the surface thereof and a hook-and-loop fastener having loop engagement elements on the surface thereof has currently been applied widely to various purposes. Furthermore, it has been known that by imparting conductivity to the hook-and-loop fasteners, the hook-and-loop fasteners are applied to an electromagnetic wave shielding material, a connector, and the like.

For example, PTL 1 describes a conductive hook-and-loop fastener including a base cloth having plural engagement elements existing thereon, having a metal material, such as aluminum and silver, vapor-deposited on the base cloth and the engagement elements. PTL 2 describes a conductive hook-and-loop fastener having a metal film, such as copper and nickel, formed through an electroless plating method on a hook surface and a loop surface of the hook-and-loop fastener, and further having a urethane resin covering the surface of the metal film to prevent the metal film from being dropped off.

PTL 3 describes a hook-and-loop fastener suitable for the dissipation of static electricity including a hook-and-loop fastener having engagement elements on the surface thereof, having an electroconductive wire wound on the substrate thereof.

PTL 4 describes a sheet having a heat generating capability including a heater engaged through a hook-and-loop fastener. PTL 5 describes thermal shoes capable of readily exchanging an electric power source for a heating means having a heat generating capability, by mounting the electric power source through a hook-and-loop fastener.

PTL 6 describes a flexible connector including a combination of hook-and-loop fasteners to be engaged with each other each having plural engagement elements formed of an insulating material disposed thereon, in which while dividing the surface having the engagement elements existing thereon into several regions, the surface of the engagement elements in the engagement element region surrounded by the insulating region is coated with a conductive material by coating a solution of a conductive polymer on the region, or by plating a metal, such as copper and nickel, on the region, so as to make the region as a conductive region.

However, among these techniques, the technique of PTL 1 has a problem that in the repeated engagement and release of the resulting conductive hook-and-loop fastener, the metal layer applied particularly to the surface of the hook engagement elements is dropped off to decrease the conductive performance rapidly. The technique of PTL 2 has a problem that in the case where the thickness of the urethane layer coated on the surface of the plated layer is increased for preventing the plated layer from being dropped off, the conductive performance disappears, but in the case where the thickness of the urethane layer is decreased for preventing the phenomenon, the plated layer cannot be prevented from being dropped off.

In the techniques of PTLs 1 and 2, furthermore, the multifilament yarns constituting the loop engagement elements in the conductive region are bundled with the resin, the metal, or the like to fail to provide a high engagement force, and the color of the surface of the hook-and-loop fastener is dark gray due to the conductive metal layer coated on the entire surface thereof, which is not preferred from aesthetics in the fields of clothing and interiors requiring fashionability. Moreover, the hook-and-loop fastener loses flexibility due to the rigid metal layer coated on the entire surface thereof, and the hook-and-loop fastener mounted on the surface of closing or the like impairs the texture and the comfort thereof.

In the techniques of PTLs 3 and 4, since the engagement elements have completely no conductive performance, even though the engagement element surfaces of the hook type hook-and-loop fastener and the loop type hook-and-loop fastener are overlapped each other, conduction of electricity does not occur from one of the hook-and-loop fasteners to the other of the hook-and-loop fasteners, and therefore the hook-and-loop fasteners cannot be applied to such purposes as a switch or a connector performing electric connection and interruption through engagement and release of the hook-and-loop fasteners, although the hook-and-loop fasteners can be applied to a purpose of electromagnetic wave shielding. Furthermore, when the cloth having the hook-and-loop fastener mounted thereon is laundered, the electroconductive wire is readily broken to lose even the electromagnetic wave shielding effect.

In the technique of PTL 5, the heating means having a heat generating capability has the conductive wire wound on the periphery thereof, and is said to generate heat through electrification, but the electric power generation efficiency is poor since the wire is disposed in a small amount and is not disposed in height direction.

In the technique of PTL 6, the repetition of engagement and release causes rapid decrease of the conductive performance due to the drop off of the conductive layer coated on the surface, and furthermore the technique is not suitable for such applications as clothing requiring flexibility since the conductive layer is applied to the entire surface of the hook-and-loop fastener in the conductive region to make the region rigid. Moreover, the technique has a problem that the multifilament yarns constituting the loop engagement elements in the conductive region are bundled with the resin, the metal, or the like to fail to provide a high engagement force.

CITATION LIST

Patent Literatures

PTL 1: JP 3-261405 A
PTL 2: JP 7-194414 A

PTL 3: JP 2012-526566 A
PTL 4: Japanese Utility Model No. 3209693
PTL 5: Japanese Utility Model No. 3174398
PTL 6: JP 2015-109172 A

SUMMARY OF INVENTION

Technical Problem

For imparting conductivity to a hook-and-loop fastener, an object of the present invention is to provide a conductive hook-and-loop fastener and a method for producing the same that solve the problems that: in the case where a conductive substance is applied to the surface of engagement elements, particularly to the surface of the hook type hook-and-loop fastener, the conductive substance applied to the surface is dropped off due to the repeated engagement and release, so as to decrease the conductive performance rapidly; in the case where a conductive substance is applied to the surface of the hook-and-loop fastener, the hook-and-loop fastener has a dark gray color due to the conductive substance, which becomes a problem in aesthetics in the fields of clothing and interiors requiring bright colors; a metal layer existing on the surface of the hook-and-loop fastener makes the hook-and-loop fastener rigid, which is not suitable in the fields of clothing and interiors requiring flexibility; the multifilament yarns constituting the loop engagement elements are bundled with the metal layer or the resin layer and thus are unlikely to be engaged to fail to provide a high engagement force; the heat generation efficiency is poor; and the like.

In view of the aforementioned problems, another object of the present invention is to provide a conductive woven fabric hook-and-loop fastener, in which in the case where the hook-and-loop fasteners are overlapped through engagement element surfaces thereof, the back surface of one of the hook-and-loop fasteners and the back surface of the other of the hook-and-loop fasteners can be electrically conducted to each other.

The present invention provides a conductive hook-and-loop fastener that has a high engagement force, undergoes less decrease in conductivity even after repeated engagement and release, is significantly flexible, furthermore is excellent in aesthetics, and is capable of being applied to the fields of clothing and interiors, and a method for producing the same.

The present invention also provides a conductive hook-and-loop fastener, in which in the case where the hook-and-loop fasteners are overlapped to make engagement element surfaces thereof facing each other, the back surface of one of the hook-and-loop fasteners and the back surface of the other of the hook-and-loop fasteners are electrically conducted to each other, and a method for producing the same.

Solution to Problem

The present invention relates to a conductive hook-and-loop fastener including a base cloth containing a woven fabric, having existing on one surface thereof plural loop engagement elements including a multifilament yarn including as at least a part thereof a conductive filament, the multifilament yarn constituting the loop engagement elements being inwoven in a warp direction of the woven fabric.

It is preferred that in the conductive hook-and-loop fastener, the loop engagement elements include a non-conductive multifilament yarn and a conductive multifilament yarn.

It is preferred that at least one of yarns existing on both right and left sides of the multifilament yarn constituting the loop engagement elements has a conductive multifilament yarn existing therein. It is preferred that a weft yarn constituting the woven fabric includes a heat fusible multifilament yarn, and roots of the loop engagement elements are fixed to the woven fabric through fusion of the heat fusible multifilament yarn. In the case where the conductive hook-and-loop fastener has hook engagement elements existing thereon, it is preferred that roots of the hook engagement elements are fixed to the woven fabric through fusion of the heat fusible multifilament yarn.

It is preferred that at least a part of a weft yarn constituting the woven fabric includes a conductive filament, and it is preferred that the hook-and-loop fastener includes plural loop engagement elements arranged in a row in a warp direction, plural hook engagement elements arranged in a row on at least one side of the row of the loop engagement elements, and a row of plural loop engagement elements existing on a side beyond the hook engagement elements, and a distance between the loop engagement element rows with the hook engagement element row intervening therebetween is twice or more the height of the loop engagement elements. The numbers of rows of the loop engagement element row and the hook engagement element row existing on the side thereof each may be one row or plural rows of 2 or more rows, and with 2 to 3 rows, electric conduction can be performed more securely through engagement of the hook-and-loop fasteners of the present invention.

It is preferred that in the conductive hook-and-loop fastener, the conductive filament constituting the loop engagement elements is exposed on a back surface of the hook-and-loop fastener, and the loop engagement elements and the back surface of the hook-and-loop fastener are electrically conducted to each other.

It is preferred that the conductive hook-and-loop fastener has the loop engagement elements that are formed by napping.

It is preferred that the conductive hook-and-loop fastener is a hook-and-loop coexistence type fastener including plural hook engagement elements including a monofilament yarn and the plural loop engagement elements, coexisting on one surface of the base cloth containing a woven fabric.

It is preferred that the monofilament yarn constituting the hook engagement elements is a non-conductive monofilament yarn.

The present invention also relates to an electronic component, a heat generating sheet, and an electromagnetic wave shielding sheet each including the conductive hook-and-loop fastener of the present invention. The electronic component is not particularly limited, and examples thereof include a switch, a connector, an electric cable, an electric power source, a light source, such as LED, and a circuit for a fan and a buzzer. The present invention also relates to clothing or shoes including at least one of the electronic component, the heat generating sheet, and the electromagnetic wave shielding sheet.

The present invention also relates to a combination of conductive hook-and-loop fasteners including two plies of the conductive hook-and-loop fasteners that are engaged through engagement element surfaces thereof, a back surface of one of the hook-and-loop fasteners and a back surface of the other of the hook-and-loop fasteners being electrically conducted to each other.

The present invention also relates to a method for producing a conductive conductive hook-and-loop fastener, including; preparing a warp yarn including a multifilament yarn, a weft yarn including a heat fusible multifilament yarn, and a yarn for loop engagement elements including a conductive filament; weaving a loop woven fabric having the yarn for loop engagement elements inwoven in a warp direction and having plural loops including the yarn for loop engagement elements rising up from a surface; and fusing the heat fusible multifilament yarn included in the weft yarn by heating the loop woven fabric, so as to fix roots of the loops to the woven fabric and to fix a shape of the loops.

The present invention also relates to a method for producing a hook-and-loop coexistence type fastener, including: preparing a warp yarn including a multifilament yarn, a weft yarn including a heat fusible multifilament yarn, a yarn for hook engagement elements including a monofilament yarn, and a yarn for loop engagement elements including a conductive filament; weaving a loop woven fabric having the yarn for hook engagement elements and the yarn for loop engagement elements inwoven in a warp direction and having plural loops including the yarn for hook engagement elements and the yarn for loop engagement elements rising up from a surface; fusing the heat fusible multifilament yarn included in the weft yarn by heating the loop woven fabric, so as to fix roots of the loops to the woven fabric and to fix a shape of the loops; and cutting roots on one side of the loops including the monofilament yarn to make hook engagement elements from the loops.

Advantageous Effects of Invention

In the present invention, the conductive hook-and-loop fastener has plural loop engagement elements including a multifilament yarn including as at least a part thereof a conductive filament. In the present invention, the conductive hook-and-loop fastener used may be a so-called hook-and-loop coexistence type fastener including hook engagement elements and loop engagement elements coexisting on one surface, in which the loop engagement elements are imparted with a function of conductivity.

The ordinary conductive hook-and-loop fastener has targeted hook-and-loop fasteners including two kinds of hook-and-loop fasteners, i.e., a hook type hook-and-loop fastener and a loop type hook-and-loop fastener, to be engaged with each other, and in this case, both the hook type hook-and-loop fastener and the loop type hook-and-loop fastener are necessarily imparted with conductivity, and in the case where the hook type hook-and-loop fastener is imparted with conductivity, the conductive film coated on the periphery of the thick hook engagement elements is dropped off in a short period of time from the surface of the engagement elements through repeated engagement and release, losing the conductive performance in a short period of time.

In the present invention, on the other hand, the loop engagement elements of the hook-and-loop coexistence type fastener are imparted with conductivity, and thereby in overlapping two plies of the hook-and-loop coexistence type fasteners, electricity flows from one of the hook-and-loop fasteners to the other of the hook-and-loop fasteners through contact among the loop engagement elements. Accordingly, the present invention is quite different in concept from the ordinary art, in which electricity flows from one of the hook-and-loop fasteners to the other of the hook-and-loop fasteners through engagement of the conductive hook engagement elements and the conductive loop engagement elements.

Furthermore, the loop engagement elements are formed of a multifilament yarn including plural filaments bundled, including a filament coated with a conductive substance as at least a part of the multifilament yarn. In this case, the conductive substance applied to the surface of the multifilament is hard to be dropped off on laundry but retains the conductive performance. Even in repeated engagement and release, the conductive substance of the conductive filament existing inside the bundled multifilament yarn is less dropped off, and even though a part thereof is dropped off, electricity flows through the remaining conductive substance of the conductive multifilament existing as bundles, resulting in the suppression of the deterioration of the conductive performance caused by repeated engagement and release.

In the conductive hook-and-loop fastener of the present invention, furthermore, the conductive substance is applied to the yarn used for the production of the hook-and-loop fastener in the stage of yarn, which is different from the ordinary conductive hook-and-loop fastener, in which the surface of the produced hook-and-loop fastener is coated with a conductive substance, and therefore the conductive hook-and-loop fastener of the present invention is largely different in flexibility from the ordinary product, in which the surface of the hook-and-loop fastener is made rigid by the conductive substance.

It is preferred in the present invention that the multifilament yarn for loop engagement elements formed of flexible thin filaments includes the conductive filament folded therein, and thereby an excellent engagement force can be obtained. Moreover, the entire surface of the hook-and-loop fastener is not coated with a black to gray conductive substance, and thereby the color tone of the hook-and-loop fastener can be freely selected by dyeing, resulting in suitability to the applications of clothing, interiors, and the like.

In the conductive hook-and-loop fastener of the present invention, furthermore, the conductive fibers of the conductive filaments are continuously disposed in the length direction and the thickness direction of the base cloth of the hook-and-loop fastener, which is different from the heat generating member using the ordinary hook-and-loop fastener, and therefore the entire surface of the hook-and-loop fastener is heated to provide a good heat generation efficiency, which is largely different from the ordinary products.

In the ordinary technique, in which a conductive substance is coated on a produced hook-and-loop fastener, there may be cases where it is difficult to attach the conductive substance to the hidden portion behind the overlap of the elements of the hook-and-loop fastener and the surface of the fiber existing inside the fiber bundle. In the ordinary hook-and-loop fastener, furthermore, an adhesive layer referred to as a backcoat resin layer is coated on the back surface of the base cloth for preventing the engagement elements from being withdrawn from the base cloth by the tension for releasing the engagement, and the presence of the layer blocks the electricity entering from the engagement elements, and inhibits the electricity from reaching the back surface of the hook-and-loop fastener.

In the conductive hook-and-loop fastener of the present invention, on the other hand, since the conductive filament is used as the yarn for loop engagement elements, i.e., a part of the yarns constituting the base cloth, and thus the conductive filament is inwoven in the base cloth of the hook-and-loop fastener, the conductive filament exists also on the back surface of the hook-and-loop fastener, so as to conduct electrically the loop engagement elements and the back surface of the hook-and-loop fastener, and thereby the electricity entering from the loop engagement elements reaches the back surface of the hook-and-loop fastener via the conductive filament.

Furthermore, in the case where a heat fusible multifilament yarn is used as the weft yarn, the multifilament yarn constituting the loop engagement elements can be fixed to the base cloth by fusing the heat fusible multifilament yarn, avoiding the necessity of the backcoat resin layer required in the ordinary technique, and thereby the conductive filament used as a part of the yarn for loop engagement elements is exposed on the back surface of the hook-and-loop fastener, and enables electric conduction between the back surface of the hook-and-loop fastener and the surface having the loop engagement elements existing thereon.

Moreover, an electronic component (such as a switch, a connector, an electric cable, an electric power source, a light source, such as LED, and a circuit for a fan and a buzzer), a heat generating sheet, and an electromagnetic wave shielding sheet including the conductive hook-and-loop fastener can be attached to a desired location and can be readily attached and detached, and therefore can be readily exchanged. These articles can be favorably applied to clothing and shoes.

DESCRIPTION OF EMBODIMENTS

First Embodiment

Figure 1:
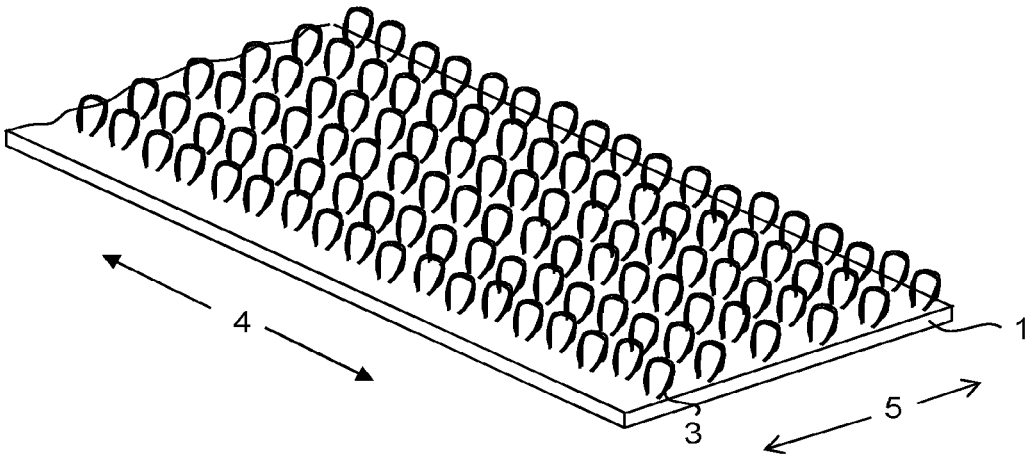
FIG. 1 is a perspective view schematically showing one preferred example of the conductive hook-and-loop fastener according to the first embodiment of the present invention.

The present invention will be described in detail below. A conductive hook-and-loop fastener according to a first embodiment of the present invention includes a base cloth having existing on the surface thereof loop engagement elements as shown in FIG. 1. In the figure, the numeral 1 denotes the base cloth, and the numeral 3 denotes the loop engagement element.

The multifilament yarn used for the loop engagement elements may be a multifilament yarn formed of a polyethylene terephthalate based polyester, a polybutylene terephthalate based polyester, a nylon 66 based polyamide, a polyphenylene sulfide, a meta-aramid, a para-aramid, a polyarylate, a polyimide, or the like.

One of the important factors in the present invention is that the multifilament yarn for the loop engagement elements includes a conductive filament as at least a part thereof.

The multifilament yarn for the loop engagement elements used in the conductive hook-and-loop fastener that is demanded to have heat resistance is preferably a multifilament yarn having heat resistance, such as a polyphenylene sulfide, a meta-aramid, and a para-aramid.

In the present invention, the multifilament yarn for the loop engagement elements is preferably a folded yarn of a non-conductive multifilament yarn and a conductive multifilament yarn since the conductive performance is hard to decrease even after repeated engagement and release. It is also preferred to use a paralleled yarn of a non-conductive multifilament yarn and a conductive multifilament yarn.

One of the important factors in the present invention is that the conductive filament is applied with a conductive substance on the surface of the filament in the stage before using in the hook-and-loop fastener, particularly in the stage before folding with the non-conductive multifilament yarn.

Examples of the conductive substance applied to the surface include known conductive metals, such as gold, silver, copper, and nickel, and examples of the method for applying the metal based conductive substance to the surface of the filament include known methods, such as an electroless plating method, an electroplating method, and a vapor deposition method. In the conductive multifilament yarn, the surfaces of the individual filaments constituting the multifilament yarn are preferably applied with the conductive substance.

The multifilament yarn for the loop engagement elements (including the conductive filament) is preferably a multifilament yarn formed of 8 to 58 filaments having a total decitex of 200 to 500 decitex including the conductive filament in an amount of 4% by mass or more, and more preferably 5 to 50% by mass, from the standpoint of the achievement of all the conductivity, the engagement force, and the durability against dropping off. Specifically, as the conductive filament, a multifilament yarn formed of 5 to 35 filaments having a total decitex of 30 to 80 decitex is preferred.

In the case where the loop engagement elements are formed of a folded yarn of the non-conductive multifilament yarn and the conductive multifilament yarn, the high engagement force is achieved mainly by the non-conductive multifilament yarn, and the conductive substance of the conductive multifilament yarn is hard to be dropped off even after repeated engagement and release, thereby preventing the deterioration of the conductive performance. As for the conductive multifilament yarn, the conductive substance thereof existing on the surface of the filament thereinside is hard to be dropped off, and thus the effect can be further enhanced.

In the conductive hook-and-loop fastener of the present invention, all the yarns for the loop engagement elements may not necessarily include the conductive filament, and it suffices that at least a part of the loop engagement elements include the conductive filament. It is preferred that most of the yarns for the loop engagement elements include the conductive filament.

In the present invention, the multifilament yarn constituting the loop engagement elements is inserted to the base cloth in the warp direction, and forms loops in several places on the surface of the base cloth, so as to form the loop engagement elements by crossing the warp yarn. As a result, the structure shown in FIG. 1 is obtained, in which plural loop engagement elements are arranged as a row also in the warp direction.

Figure 2:
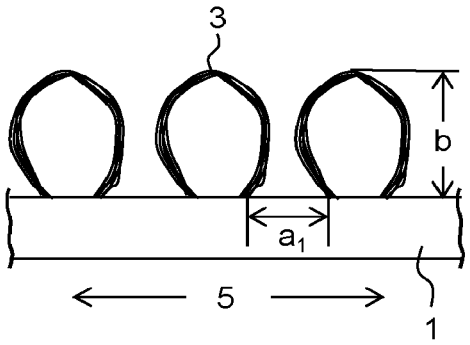
FIG. 2 is an enlarged view schematically showing the cross section in parallel to the weft direction of one preferred example of the conductive hook-and-loop fastener according to the first embodiment of the present invention.

In the present invention, the loop engagement elements are arranged in the weft direction 5 as shown in FIG. 2. In FIG. 2, the symbol $a_1$ denotes the distance between the loop engagement elements adjacent to each other, and the symbol b denotes the height of the loop engagement elements.

The distance $a_1$ between the loop engagement elements is preferably 0.2 to 1.5 mm, more preferably 0.3 to 1.0 mm, and further preferably 0.4 to 0.8 mm, from the standpoint of the securement of the electric conduction among the loop engagement elements.

The distance $a_1$ between the loop engagement elements herein means the average value of arbitrary 10 points of the distances $a_1$ between the closer sides of the roots of the loop engagement elements adjacent to each other in the weft direction 5 as shown in FIG. 2.

The height b of the loop engagement elements is preferably 1.6 to 4.0 mm, more preferably 1.8 to 3.5 mm, and further preferably 2.0 to 3.0 mm, from the standpoint of the securement of the electric conduction between the hook-and-loop fasteners in overlapping the hook-and-loop fasteners and the achievement of the flexible texture.

The height b of the loop engagement elements herein means the average of 10 points of the heights b of the arbitrary loop engagement elements obtained at arbitrary 10 points.

In the present invention, the density of the loop engagement elements is preferably 20 to 40 per $cm^2$, and particularly preferably 25 to 35 per $cm^2$, in terms of multifilament, from the standpoint of the securement of the electric conduction.

The loop engagement elements in the present invention may be formed by napping. In the case where the loop engagement elements are formed by napping, i.e., formed by raising a knitted fabric, the engagement capability and the flexibility can be enhanced.

In the present invention, the density of the loop engagement elements formed by napping is preferably 30 to 120 per $cm^2$, and particularly preferably 80 to 120 per $cm^2$, in terms of multifilament, from the standpoint of the securement of the electric conduction.

In the hook-and-loop fastener of the present invention, the warp yarn constituting the base cloth may be a yarn formed of a polyethylene terephthalate based polyester, a polybutylene terephthalate based polyester, a nylon 66 based polyamide, a polyphenylene sulfide, a meta-aramid, a para-aramid, a polyarylate, a polyimide, or the like.

The warp yarn continuously exists in the length direction of the hook-and-loop fastener and provides process stability in the production of the hook-and-loop fastener, and therefore is preferably a yarn that hardly undergoes dimensional change in the production process, and particularly undergoes less changes, such as contraction, under the heat treatment condition, and accordingly a multifilament yarn formed of a polyethylene terephthalate homopolymer is particularly preferred.

The warp yarn that is used in the conductive hook-and-loop fastener that is demanded to have heat resistance is preferably a multifilament yarn having heat resistance, such as a polyphenylene sulfide, a meta-aramid, and a para-aramid.

As for the thickness of the multifilament yarn constituting the warp yarn, a multifilament yarn formed of 8 to 50 filaments having a total decitex of 100 to 250 decitex is preferred, and a multifilament yarn formed of 10 to 40 filaments having a total decitex of 120 to 200 decitex is particularly preferred. The base cloth may be constituted with the multifilament yarn in a warp yarn weave density of 60 to 90 per cm.

The multifilament yarn constituting the loop engagement elements is inwoven in the woven fabric in the warp direction as described above. The number of the multifilament yarns for the loop engagement elements inwoven in total is preferably 3 to 6 per 20 of warp yarns (including the multifilament yarns for the loop engagement elements), and it is particularly preferred that the multifilament yarns are inwoven in such a manner that one of five warp yarns is the yarn for the engagement elements at regular intervals.

The weft yarn used in the base cloth of the conductive hook-and-loop fastener of the present invention is preferably a multifilament yarn formed of core-sheath type composite fibers including, as a sheath component, a low melting point resin capable of firmly fixing the roots of the loops formed of the multifilament yarn for the loop engagement elements to the base cloth through heat fusion under the aforementioned heat treatment condition, or a multifilament yarn including the multifilament yarn.

The sheath component preferably contains inorganic fine particles added in an amount of 0.03 to 1% by mass. Examples of the inorganic fine particles include titanium oxide, zinc oxide, silicon oxide, and barium sulfate, and among these, titanium oxide is particularly preferred.

At the time when the sheath component is melted to use as a binder, the inorganic fine particles added in the aforementioned amount can prevent the molten binder resin from being widely spread to penetrate into the base cloth, and as a result, the base cloth can be prevented from being hardened, which becomes suitable for clothing and the like. In the case where the amount thereof added is less than 0.03% by mass, the resin cannot be sufficiently prevented from being spread, and in the case where the amount thereof exceeds 1% by mass, the capability of the molten resin for fixing the roots of the loops formed of the multifilament yarn for the loop engagement elements may be poor, and the engagement elements may be readily withdrawn through repeated engagement and release. It is more preferred that the inorganic fine particles are added in an amount of 0.04 to 0.8% by mass.

The sheath component resin of the core-sheath type heat fusible fibers as the weft yean preferably have a melting point or a softening point that is lower than all the multifilament yarn for the loop engagement elements, the warp yarn, and the core forming resin of the core-sheath type heat fusible fibers, and more preferably is a resin having a melting point or a softening point that is lower by 20° C. or more, and further preferably lower by 30° C. or more.

Specifically, the sheath component resin is preferably a polyester based resin having a melting point or a softening point of 150 to 200° C. Preferred examples thereof include a polyethylene terephthalate based or polybutylene terephthalate based polyester resin having 15 to 30% of isophthalic acid, sodium sulfoisophthalate, ethylene glycol, propylene glycol, or the like copolymerized therewith, from the standpoint of the withdrawing resistance of the engagement elements.

The core component resin is preferably a polyester based resin from the standpoint of the exfoliation resistance to the sheath component resin, example of which include a polyethylene terephthalate homopolymer and a polybutylene terephthalate homopolymer since a high melting point is demanded, and among these, a polyethylene terephthalate homopolymer is particularly preferred from the standpoint of the morphological stability.

The ratio of the core component and the sheath component in the core-sheath composite fibers is preferably 60/40 to 80/20 in terms of weight ratio. The proportion of the core-sheath type heat fusible filament occupied in the filaments constituting the weft yarn is preferably 25 to 100% by mass. Representative examples of the filament other than the core-sheath type heat fusible filament constituting the weft yarn include an ordinary polyester based or polyamide based non-heat fusible multifilament yarn and a polyphenylene sulfide based multifilament yarn.

As for the thickness of the multifilament yarn constituting the weft yarn, a multifilament yarn formed of 12 to 72 filaments having a total decitex of 100 to 300 decitex is preferred, and a multifilament yarn formed of 24 to 48 filaments having a total decitex of 150 to 250 decitex is particularly preferred.

The multifilament yarn for the weft yarn is preferably inwoven in the base cloth in a weave density of 15 to 25 per cm.

The mass proportion of the weft yarn is preferably 15 to 40% based on the total mass of the multifilament yarn for the loop engagement elements, the warp yarn, and the weft yarn constituting the hook-and-loop fastener.

The weave structure of the base cloth (woven fabric) is preferably plain weave including the multifilament yarn for the loop engagement elements as a part of the warp yarn.

The woven fabric having many loops as engagement elements on the surface thereof obtained by weaving these yarns is then heated for fixing the loop shape of the loops as engagement elements. In the case where the heat fusible multifilament yarn is used as the weft yarn in the hook-and-loop fastener of the present invention, the heat applied for fixing the loop shape simultaneously fuses the heat fusible multifilament yarn of the weft yarn constituting the base cloth, so as to fix the loop engagement elements to the base cloth. Accordingly, the temperature of the heat applied is generally preferably 160 to 220° C., which is the temperature of melting the heat fusible multifilament yarn and also is a temperature of heat-fixing the multifilament yarn for the loop engagement elements, and is more preferably in a range of 170 to 210° C.

In the present invention, as described above, it is preferred that the fibers constituting the base cloth are heat-fused to fix the roots of the loop engagement elements firmly to the base cloth, and therefore not only a backcoat resin layer coated on the back surface of the base cloth in the ordinary hook-and-loop fastener is not necessary, but also due to the absence of the backcoat resin layer coated, an electric signal conducted to the loop engagement elements existing on the surface of the hook-and-loop fastener can be directly conducted to the back surface of the hook-and-loop fastener.

The conductive hook-and-loop fastener can be used in two ways, i.e., the case where one electric signal is conducted with one pair of the conductive hook-and-loop fasteners (i.e., two hook-and-loop fasteners overlapped each other) (which may be referred to as a single path type), and the case where the surfaces of the hook-and-loop fasteners are divided into plural conduction paths insulated from each other, and electric signals are conducted through the paths respectively (which may be referred to as a multipath type).

Representative applications of the single path type include a switch purpose, and a use method of releasing the engagement of the hook-and-loop fasteners to interrupt electricity is exemplified. Examples thereof include such a purpose that a flexible solar power generation panel is attached to the surface of clothing with the conductive hook-and-loop fastener of the present invention, and an electric device inside the clothing is driven by electricity obtained thereby.

Examples of the multipath type include clothing equipped with bioelectrodes, which can be used in such a manner that plural electric signals including brain waves, an electrocardiogram, a blood oxygen level, and the like can be conducted with one pair of the hook-and-loop fasteners, and the devices can be detached on laundry of the clothing.

In the case of the multipath type in these two use methods, it is preferred that the conductive hook-and-loop fastener has the multifilament yarn constituting the loop engagement elements including the conductive filament is inwoven in the woven fabric in the warp direction, and at least one of the two warp yarns existing on both right and left sides of the multifilament yarn constituting the loop engagement elements includes a conductive filament. According to the structure, an electric signal or the like conducted from the loop engagement elements can be more securely taken out from the back surface of the hook-and-loop fastener.

Specifically, since the warp yarns existing on both right and left sides of the multifilament yarn constituting the loop engagement elements are in contact with the multifilament yarn constituting the loop engagement elements and simultaneously have sink-float relationships with respect to the weft yarn that are inverse to each other, the position on the back surface of the base cloth having the multifilament yarn existing therein securely has any one of the multifilament yarn for the loop engagement elements including the conductive filament and the conductive warp yarn existing adjacent thereto, and thereby an electric signal conducted from the loop engagement elements can be more securely taken out from the back surface of the hook-and-loop fastener.

It is also preferred that the group of conductive yarns including the conductive multifilament yarns for the warp yarn including the conductive filament existing therein and the conductive yarns for the loop engagement elements intervenes between groups of non-conductive yarns, for the securement of the plural paths insulated from each other.

By using the warp yarn including the conductive filament in this manner, plural information conduction paths can be achieved by one pair of the hook-and-loop fasteners.

The conductive hook-and-loop fastener of the present invention can be used as a combination with a conductive hook type hook-and-loop fastener having only hook engagement elements on the surface thereof, can be used as a combination with a hook-and-loop fastener other than the conductive hook-and-loop fastener, and can also be used as a conductive sheet for applications other than engagement.

Second Embodiment

A conductive hook-and-loop fastener according to a second embodiment of the present invention will be described. The descriptions for the constitutional members and the like that are common to the conductive hook-and-loop fastener according to the first embodiment may be omitted.

The conductive hook-and-loop fastener according to the second embodiment of the present invention is a so-called hook-and-loop coexistence type cloth fastener including a base cloth having hook engagement elements and loop engagement elements coexisting on the surface thereof as shown in FIG. 2. In the figure, the numeral 1 denotes the base cloth, the numeral 2 denotes the hook engagement element, and the numeral 3 denotes the loop engagement element. Accordingly, the hook-and-loop fastener of the present invention may be a hook-and-loop coexistence type fastener in such a state that the base cloth having a size of a 1 cm square cut from the base cloth having the engagement elements existing thereon has both the hook engagement elements and the loop engagement elements existing on the base cloth thus cut.

The conductive hook-and-loop coexistence type fastener of the present invention is constituted mainly by a monofilament yarn for hook engagement elements, a multifilament yarn for loop engagement elements, a warp yarn, and a weft yarn.

The hook engagement elements in the conductive hook-and-loop coexistence type fastener of the present invention may be the similar ones described for the first embodiment.

The monofilament yarn for the hook engagement elements is demanded to have a so-called hook shape retention capacity, in which the hook shape is not extended with a light force, and a thick rigid monofilament yarn formed of synthetic fibers may be used therefor. In the present invention, this monofilament yarn used may be a monofilament yarn formed of a polyethylene terephthalate based polyester, a polybutylene terephthalate based polyester, a nylon 66 based polyamide, a polyphenylene sulfide, a meta-aramid, a para-aramid, a polyarylate, a polyimide, or the like.

The thickness of the monofilament yarn for the hook engagement elements is preferably 0.12 to 0.30 mm in diameter from the standpoint of the engagement force and the weaving capability, and is more preferably in a range of 0.15 to 0.25 mm in diameter.

The monofilament yarn for the hook engagement elements used in the conductive hook-and-loop fastener that is demanded to have heat resistance is preferably a multifilament yarn having heat resistance, such as a polyphenylene sulfide, a meta-aramid, and a para-aramid.

In the present invention, it is preferred that the height of the hook engagement elements is 1.5 to 3.0 mm, the height of the loop engagement elements is 1.6 to 4.0 mm, and the loop engagement elements are higher than the hook engagement elements by 0.1 to 1.0 mm, from the standpoint of the securement of electric conduction between the hook-and-loop fasteners overlapped each other and the standpoint of the achievement of the flexible texture.

It is more preferred that the height of the hook engagement elements is 1.8 to 2.5 mm, the height of the loop engagement elements is 2.0 to 3.3 mm, and the loop engagement elements are higher than the hook engagement elements by 0.2 to 0.8 mm. The height of the engagement elements herein means the average value of the distance between the surface of the woven fabric base cloth and the top (i.e., the highest position in the vertical direction from the surface of the base cloth) of the engagement element of 10 engagement elements randomly selected, and can be readily obtained from the cross sectional photograph of the hook-and-loop fastener.

In the present invention, the density of the hook engagement elements is preferably 20 to 40 per $cm^2$, and particularly preferably 25 to 35 per $cm^2$, and the density of the loop engagement elements is preferably 20 to 40 per $cm^2$, and particularly preferably 25 to 35 per $cm^2$, in terms of multifilament. The ratio (hook engagement element density)/(loop engagement element density) is preferably in a range of 1/0.5 to 1.5 from the standpoint of the securement of the conductivity and the achievement of the high engagement force, and is more preferably in a range of 1/0.8 to 1.2.

In the present invention, both the monofilament yarn constituting the hook engagement elements and the multifilament yarn constituting the loop engagement elements are inserted to the base cloth in the warp direction, and form loops for the hook engagement elements in several places by crossing the warp yarn, and also form loops for the loop engagement elements on the surface of the base cloth in several places by crossing the warp yarn. As a result, the structure shown in FIG. 3 is obtained, in which plural hook engagement elements are arranged as a row in the warp direction, and plural loop engagement elements are arranged as a row also in the warp direction.

Figure 3:
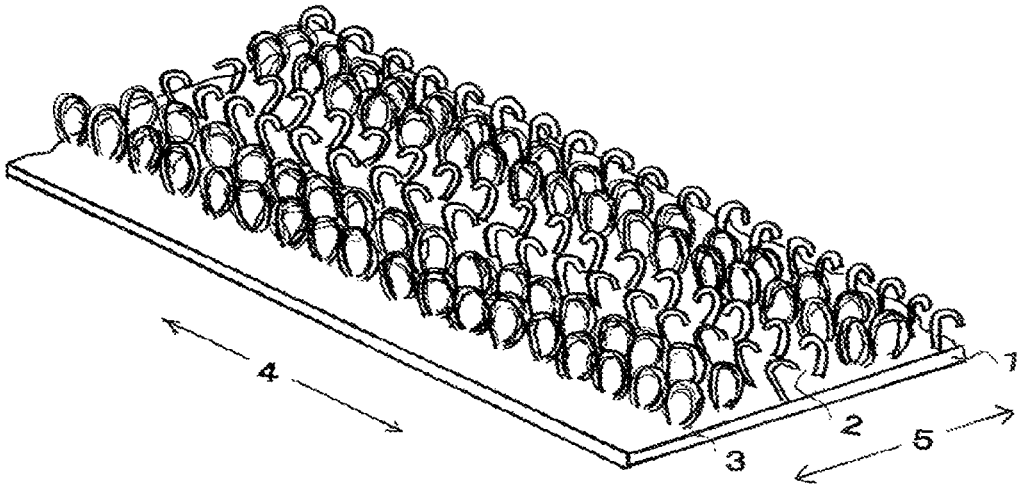
FIG. 3 is a perspective view schematically showing one preferred example of the conductive hook-and-loop fastener according to the second embodiment of the present invention.

For further securing the conductivity and the engagement force, it is preferred that plural rows of the loop engagement elements are arranged in the warp direction adjacent to each other, and plural rows of the hook engagement elements exist in the warp direction adjacent to the plural rows of the loop engagement elements, i.e., the plural rows exist alternately, and it is particularly preferred that as shown in FIG. 3, the basic repeating unit of arrangement is the structure having the rows of the loop engagement elements and the rows of the hook engagement elements existing alternately every two rows, in which the roots of the two rows of the hook engagement elements on the side of the center of the rows are cut.

The multifilament yarn constituting the monofilament yarn constituting the hook engagement elements is inwoven in the woven fabric in the warp direction as described above. The number of the monofilament yarns for the hook engagement elements inwoven in total is preferably 3 to 6 per 20 of warp yarns (including the monofilament yarns for the hook engagement elements), and it is particularly preferred that the monofilament yarns are inwoven in such a manner that one of five warp yarns is the yarn for the engagement elements at regular intervals.

The weft yarn used in the base cloth of the conductive hook-and-loop fastener of the present invention is preferably a multifilament yarn formed of core-sheath type composite fibers including, as a sheath component, a low melting point resin capable of firmly fixing the roots of the loops formed of the monofilament yarn for the hook engagement elements and the multifilament yarn for the loop engagement elements to the base cloth through heat fusion under the aforementioned heat treatment condition, or a multifilament yarn including the multifilament yarn.

The sheath component preferably contains inorganic fine particles added in an amount of 0.03 to 1% by mass. Examples of the inorganic fine particles include titanium oxide, zinc oxide, silicon oxide, and barium sulfate, and among these, titanium oxide is particularly preferred.

At the time when the sheath component is melted to use as a binder, the inorganic fine particles added in the aforementioned amount can prevent the molten binder resin from being widely spread to penetrate into the base cloth, and as a result, the base cloth can be prevented from being hardened, which becomes suitable for clothing and the like. In the case where the amount thereof added is less than 0.03% by mass, the resin cannot be sufficiently prevented from being spread, and in the case where the amount thereof exceeds 1% by mass, the capability of the molten resin for fixing the roots of the loops formed of the monofilament yarn for the hook engagement elements and the multifilament yarn for the loop engagement elements may be poor, and the engagement elements may be readily withdrawn through repeated engagement and release. It is more preferred that the inorganic fine particles are added in an amount of 0.04 to 0.8% by mass.

The sheath component resin of the core-sheath type heat fusible fibers as the weft yean preferably have a melting point or a softening point that is lower than all the monofilament yarn for the hook engagement elements, the multifilament yarn for the loop engagement elements, the warp yarn, and the core forming resin of the core-sheath type heat fusible fibers, and more preferably is a resin having a melting point or a softening point that is lower by 20° C. or more, and further preferably lower by 30° C. or more.

Specifically, the sheath component resin is preferably a polyester based resin having a melting point or a softening point of 150 to 200° C. Preferred examples thereof include a polyethylene terephthalate based or polybutylene terephthalate based polyester resin having 15 to 30% of isophthalic acid, sodium sulfoisophthalate, ethylene glycol, propylene glycol, or the like copolymerized therewith, from the standpoint of the withdrawing resistance of the engagement elements.

The core component resin is preferably a polyester based resin from the standpoint of the drop off resistance to the sheath component resin, example of which include a polyethylene terephthalate homopolymer and a polybutylene terephthalate homopolymer since a high melting point is demanded, and among these, a polyethylene terephthalate homopolymer is particularly preferred from the standpoint of the morphological stability.

The ratio of the core component and the sheath component in the core-sheath composite fibers is preferably 60/40 to 80/20 in terms of weight ratio. The proportion of the core-sheath type heat fusible filament occupied in the filaments constituting the weft yarn is preferably 25 to 100% by mass. Representative examples of the filament other than the core-sheath type heat fusible filament constituting the weft yarn include an ordinary polyester based or polyamide based non-heat fusible multifilament yarn and a polyphenylene sulfide based multifilament yarn.

As for the thickness of the multifilament yarn constituting the weft yarn, a multifilament yarn formed of 12 to 72 filaments having a total decitex of 100 to 300 decitex is preferred, and a multifilament yarn formed of 24 to 48 filaments having a total decitex of 150 to 250 decitex is particularly preferred.

The multifilament yarn for the weft yarn is preferably inwoven in the base cloth in a weave density of 15 to 25 per cm.

The mass proportion of the weft yarn is preferably 15 to 40% based on the total mass of the monofilament yarn for the hook engagement elements, the multifilament yarn for the loop engagement elements, the warp yarn, and the weft yarn constituting the hook-and-loop fastener.

The weave structure of the base cloth (woven fabric) is preferably plain weave including the monofilament yarn for the hook engagement elements and the multifilament yarn for the loop engagement elements as a part of the warp yarn, and in the yarns for the engagement elements, particularly the monofilament yarn for the hook engagement elements preferably has such a structure that the yarn rises up from the surface of the base cloth in the middle of the structure and enters into among the weft yarns after jumping over 1 to 4 warp yarns to form a loop since the side of the loop for the hook engagement element can be cut without damaging the loop for the loop engagement element.

The woven fabric having many loops for engagement elements on the surface thereof obtained by weaving these yarns is then heated for fixing the loop shape of the loops as engagement elements. In the case where the heat fusible multifilament yarn is used as the weft yarn in the hook-and-loop fastener of the present invention, the heat applied for fixing the loop shape simultaneously fuses the heat fusible multifilament yarn of the weft yarn constituting the base cloth, so as to fix the hook engagement elements and the loop engagement elements to the base cloth. Accordingly, the temperature of the heat applied is generally preferably 160 to 220° C., which is the temperature of melting the heat fusible multifilament yarn and also is a temperature of heat-fixing the monofilament yarn for the hook engagement elements and the multifilament yarn for the loop engagement elements, and is more preferably in a range of 170 to 210° C.

In the woven fabric for the hook-and-loop fastener having been subjected to the heat treatment, subsequently, the roots on one side of the loops for the hook engagement elements are cut to make the loops into the hook engagement elements. In cutting the roots on one side of the hook engagement elements, it is preferred that, as shown in FIG. 4, at least two rows (two rows in FIG. 4) of the hook engagement elements are disposed adjacent to each other in the weft direction, with the rows of the loop engagement elements disposed adjacent thereto, and then the roots of the loops for the hook engagement elements remote from the loop engagement elements are cut, so as to prevent the multifilament of the loop engagement elements from being damaged.

In the present invention, as described above, it is preferred that the fibers constituting the base cloth are heat-fused to fix the roots of the loop engagement elements and the hook engagement elements firmly to the base cloth, and therefore not only a backcoat resin layer coated on the back surface of the base cloth in the ordinary hook-and-loop fastener is not necessary, but also due to the absence of the backcoat resin layer coated, an electric signal conducted to the loop engagement elements existing on the surface of the hook-and-loop fastener can be directly conducted to the back surface of the hook-and-loop fastener.

In the case where the multipath type is to be obtained, such a conductive hook-and-loop fastener is preferred that includes plural loop engagement elements arranged as a row in the warp direction, plural hook engagement elements arranged in a row on at least one side of the row of the loop engagement elements, and a row of plural loop engagement elements existing on a side beyond the hook engagement elements, and the distance between the loop engagement element rows with the hook engagement element row intervening therebetween is twice or more the height of the loop engagement elements. In the case where the distance is satisfied, the electric signal conducted to the loop engagement elements can be prevented from being conducted in the weft direction, and thereby plural independent information conduction paths can be securely provided.

Figure 4:
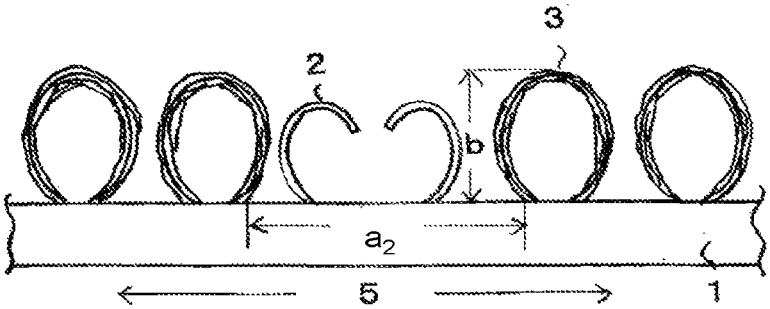
FIG. 4 is an enlarged view schematically showing the cross section in parallel to the weft direction of one preferred example of the conductive hook-and-loop fastener according to the second embodiment of the present invention.

FIG. 4 shows the structure comprehensively. In FIG. 4, the symbol $a_2$ denotes the distance between the loop engagement element rows with the hook engagement element rows intervening therebetween, and the symbol b denotes the height of the loop engagement elements. In the case where $a_2$ is 2b or more, as apparent from FIG. 4, the loop engagement elements existing with the hook engagement element rows intervening therebetween are not brought into contact with each other even though the loop engagement elements collapse, and thereby electricity can be prevented from flowing between the loop engagement elements existing with the hook engagement element rows intervening therebetween, securely providing independent information conduction paths. The distance between the loop engagement element rows with the hook engagement element row intervening therebetween herein means the average value of arbitrary 10 points of the distances $a_2$ between the closer sides of the roots of the loops existing with the hooks intervening therebetween in the weft direction 5 as shown in FIG. 4. The height of the loop engagement elements herein means the average of 10 points of the heights b of the arbitrary loop engagement elements obtained at the aforementioned arbitrary 10 points.

In the case where the hook-and-loop fastener is used as the single path type, at least a part of the weft yarn constituting the woven fabric preferably includes the conductive filament, and thereby an electric signal entering from the loop engagement elements can be conducted in the weft direction and conducted over the entire surface of the hook-and-loop fastener. Furthermore, in the case where the conductive hook-and-loop fastener includes plural loop engagement elements arranged as a row in the warp direction, plural hook engagement elements arranged in a row on at least one side of the row of the loop engagement elements, and a row of plural loop engagement elements existing on a side beyond the hook engagement elements, with a distance between the loop engagement element rows with the hook engagement element row intervening therebetween of less than twice the height of the loop engagement elements, the loop engagement elements adjacent to each other in the weft direction are brought into contact with each other, and electricity flows in the weft direction, enabling the use as the single path type (which is the case where 2*b* exceeds $a_2$ shown in FIG. 4, and in this case, electricity flows between the loop engagement elements existing with the hook engagement element rows intervening therebetween). Furthermore, in the case where two plies of the conductive hook-and-loop fasteners are overlapped each other in such a manner that the warp yarns of the two plies of the conductive hook-and-loop fasteners cross each other, electricity flows in the weft direction of the hook-and-loop fastener, enabling the use as the single path type.

The conductive hook-and-loop fastener of the present invention not only can be used by overlapping two plies thereof, but also can be used as a combination with a conductive hook type hook-and-loop fastener having only hook engagement elements on the surface thereof and a conductive loop type hook-and-loop fastener having only loop engagement elements on the surface thereof, can be used as a combination with a hook-and-loop fastener other than the conductive hook-and-loop fastener, and can also be used as a conductive sheet for applications other than engagement.

(Applications)

Specific applications of the conductive hook-and-loop fastener of the present invention utilizing the conductivity thereof preferably include a flexible switch, a flexible electricity conducting means, and a component of a flexible multipath electricity conducting means, for example, an electronic component, such as a connector, an electric cable, an electric power source, a light source, such as LED, a fan, a toy, and a buzzer, from the standpoint of the easiness in attachment and detachment, the standpoint of the ability to attach to desired locations, and the easiness in exchange. In particular, the use thereof in clothing and shoes is excellent in visibility and fashionability. Furthermore, the conductive hook-and-loop fastener is suitable as an electromagnetic wave shielding sheet as a component of wearable devices and terminals, such as a fastener for a flexible electromagnetic wave shielding material, a flexible static electricity removing material, and the like. The application thereof to electromagnetic wave shielding or the like of clothing, interiors, exteriors, infrastructures, and the like is preferred from the standpoint of the easiness in attachment after wiring and the standpoint of the easiness in attachment and detachment. Moreover, an article using the conductive hook-and-loop fastener of the invention can be detected with a metal detector. In addition, the conductive hook-and-loop fastener can be favorably applied to a sensor detecting contact with a liquid, a heat radiation sheet, and a heat generating sheet as a heat generator. The conductive hook-and-loop fastener of the present invention generates heat by applying electricity to the heat generating sheet using the conductive hook-and-loop fastener, and therefore the conductive hook-and-loop fastener of the present invention can be favorably used as a planar heat generator, such as a heater for clothing (including hats and caps), shoes, and the like from the standpoint of the easiness in attachment to clothing and shoes by sewing, the ability to attach and detach on laundry, and the easiness in fixing to desired locations.

EXAMPLES

The present invention will be described with reference to examples below. In the examples, the electric resistance value was measured in such a manner that two plies of specimens each measured 120 mm in length and 25 mm in width were engaged through end portions of 50 mm in the length direction, the engaged portion was pressed with a 2 kg roller by two reciprocations, then a length of 150 mm between gauge points including the engaged portion was held with eyeball clips, and the electric resistance value was measured with a circuit tester at positions in parallel to the warp yarn remote from the edge in the width direction by a certain length between the eyeball clips, and the engagement strength was measured for a width of 100 mm of the hook-and-loop fastener according to JIS L3416. The term "unmeasurable" for the electric resistance value means that the electric resistance was infinite, i.e., there was completely no conductivity.

Example 1

The following yarns were prepared as a warp yarn and a weft yarn constituting a base cloth, a monofilament yarn for hook engagement elements, and a multifilament yarn for loop engagement elements.

[Warp Yarn]

Multifilament yarn formed of polyethylene terephthalate having a melting point of 260° C.

Total decitex and number of filaments: 164 decitex and 30 filaments

[Weft Yarn (Multifilament Heat Fusible Yarn formed of Core-Sheath Composite Fibers)]

Core component: polyethylene terephthalate (melting point: 260° C.)

Sheath component: polybutylene terephthalate copolymerized with 25% by mol of isophthalic acid (softening point: 180° C.) containing 0.08% by mass of titanium oxide as inorganic fine particles Core-sheath ratio (weight ratio): 7/3

Total decitex and number of filaments: 198 decitex and 48 filaments

[Monofilament Yarn for Hook Engagement Elements]

Polyethylene terephthalate fibers (melting point: 260° C.)

Fineness: 355 decitex (diameter: 0.18 mm)

[Multifilament Yarn for Loop Engagement Elements]

Folded yarn of multifilament yarn formed of polybutylene terephthalate and multifilament yarn formed of nylon plated with silver (melting point: 220° C.)

Total decitex and number of filaments of the multifilament yarn formed of polybutylene terephthalate: 305 decitex and 8 filaments Total decitex and number of filaments of the multifilament yarn formed of nylon plated with silver: 33 decitex and 7 filaments A tape was woven with the aforementioned four kinds of yarns by disposing the monofilament for hook engagement elements and the multifilament for loop engagement elements in such a manner that the arrangement of two rows of hook engagement elements provided in the length direction and two rows of loop engagement elements provided adjacent thereto was repeated. The loop engagement elements were disposed to exist on both outer sides, so that the loop engagement elements were touched on toughing the surface. The weave structure was plane weave with weave densities of 72 per cm for the ground warp yarn and 16 per cm for the ground weft yarn, in which the monofilament for hook engagement elements was inwoven in a ratio of two per eight ground warp yarns, and the multifilament for loop engagement elements was inwoven in a ratio of two per eight ground warp yarns. To the warp yarn existing on one side of the yarn for loop engagement elements, a multifilament yarn having a total decitex of 33 decitex including 7 filaments formed of nylon plated with silver was added by paralleling.

The tape thus woven under the aforementioned condition was subjected to a heat treatment at 200° C. in a temperature range, in which only the sheath component of the weft yarn was melted, and the warp yarn, the multifilament for loop engagement elements, the monofilament for hook engagement elements, and the core component of the weft yarn were not melted. The sheath component of the weft yarn was melted to fuse the yarns existing nearby. The resulting woven fabric was cooled, and then the roots on one side of the loops for hook engagement elements (i.e., the roots remote from the loop engagement elements) were cut to form hook engagement elements.

The resulting hook-and-loop coexistence type fastener had a density of the hook engagement elements of 30 per $cm^2$, a density of the loop engagement elements of 31 per $cm^2$, and heights of the hook engagement elements and the loop engagement elements from the surface of the base cloth of 1.8 mm and 2.4 mm respectively. The distance between the rows of the loop engagement elements with the row of the hook engagement elements intervening therebetween was 1.5 times the height of the loop engagement elements.

The resulting hook-and-loop coexistence type fastener underwent no decrease in flexibility due to the addition of the plated multifilament yarn formed of nylon, and as for the color tone thereof, the plated yarn was substantially not noticeable, the tape dyed in dark red with a disperse dye had a clear dark red color, and thus, as for the aesthetics thereof, the presence of the plated yarn provided substantially no problem.

The conductive hook-and-loop fasteners were overlapped each other through the engagement surfaces with the warp directions paralleled to each other, and the electric resistance value between the back surface of one hook-and-loop fastener and the back surface of the other hook-and-loop fastener was measured at both end portion in the paralleled warp directions. As a result, the electric resistance value was 5Ω, from which a sufficient conductivity was confirmed. The initial engagement force of the hook-and-loop fasteners (in the peeling direction for 25 mm width) was 0.8 N/cm, from which a sufficient engagement force was confirmed. After repeating engagement and release of the hook-and-loop fasteners 1,000 times, the measurement of the electric resistance revealed 14Ω, from which a sufficient conductivity was confirmed. The engagement force was 0.70 N/cm, from which there was substantially no decrease of the engagement force even after the repeated engagement and release.

The hook-and-loop fastener was repeatedly washed 20 times with an ordinary laundry machine, but there was no decrease of the electric resistance value and the engagement force.

A fastener for shoes (a substitute of a shoelace) having the hook-and-loop fastener with an LED board attached thereto, in which the LED board was electrified by fastening the Hook-and-loop fastener to emit light from the LED, was produced, and was excellent in visibility at night and fashionability. A wired portion was held with two plies of the hook-and-loop fasteners to cover the entire length direction thereof, and it was confirmed that an electromagnetic wave emitted from the wired portion was suppressed thereby. Both ends of the hook-and-loop fastener were held with eyeball clips, and by applying an electricity of 10 V to the eyeball clips, heat generation at 40 degrees or more from the hook-and-loop fastener was confirmed. Shoes having the hook-and-loop fastener as a heat generating portion mounted thereon were produced and wore, and warmth was felt at the position of the body in contact with the hook-and-loop fastener.

Comparative Example 1

A hook-and-loop coexistence type fastener was produced in the manner in Example 1 in which the plated multifilament yarn formed of nylon was not added to a part of the yarn for loop engagement elements or the warp yarn, but the surface of the resulting hook-and-loop coexistence type fastener was subjected to a silver plating treatment to provide a conductive hook-and-loop coexistence type fastener. The resulting conductive hook-and-loop fasteners were overlapped each other and measured for the electric resistance value in the same manner as in Example 1, and the electric resistance was 5Ω providing conductivity as similar to Example 1 in the initial stage, but after the repeated engagement and release 1,000 times, became too high and unmeasurable, from which the conductivity was confirmed to be completely lost. It is estimated that the plating on the surface was dropped off due to the repeated engagement and release, and as a result, the conductivity disappears. The initial engagement force was 0.5 N/cm, which was approximately half of the hook-and-loop fastener of Example 1.

The hook-and-loop fastener had a surface in a dark gray color and a hard texture, and was not suitable for the fields of clothing and the like.

Reference Example 1

A conductive hook type hook-and-loop fastener and a conductive loop type hook-and-loop fastener were produced in the same manner as in Example 1 except that in Example 1, the hook engagement elements and the loop engagement elements were not provided on one hook-and-loop fastener but were provided on separate hook-and-loop fasteners, and a polyethylene terephthalate monofilament yarn plated with silver was used as the yarn for hook engagement elements. The densities of the engagement elements of the conductive hook type hook-and-loop fastener and the conductive loop type hook-and-loop fastener thus obtained were 40 per $cm^2$ and 40 per $cm^2$ respectively.

The conductive hook type hook-and-loop fastener and the conductive loop type hook-and-loop fastener were overlapped and engaged each other and measured for the electric resistance value, but the electric resistance value was unmeasurable in some cases depending on the measured positions, and the hook-and-loop fasteners were not said to have a stable conductivity. The reason thereof is considered that the conductivity is lost depending on the measured positions in some cases by cutting roots on one side of the hook engagement elements.

Example 2

A conductive hook-and-loop coexistence type fastener was produced in the same manner as in Example 1 except that in Example 1, the same multifilament yarn formed of nylon plated with silver as used in Example 1 was added to the warp yarns existing on both sides of the yarn for loop engagement elements.

Two plies of the conductive hook-and-loop fasteners were overlapped each other and measured for the electric resistance value in the same manner as in Example 1. As a result, the electric resistance value was 3Ω, from which a better conductivity than Example 1 was confirmed. The initial engagement force of the hook-and-loop fasteners (in the peeling direction for 100 mm width) was 1.0 N/cm, from which a sufficient engagement force was confirmed. After repeating engagement and release of the hook-and-loop fasteners 1,000 times, the measurement of the electric resistance revealed 10Ω, from which a sufficient conductivity was confirmed. The engagement force was 0.92 N/cm, from which there was substantially no decrease of the engagement force even after the repeated engagement and release. Furthermore, the flexibility, the aesthetics by color tone and dyeing capability, the conductivity, the laundry durability, the electromagnetic wave shielding capability, and the heat generating capability were also excellent as equivalent to the hook-and-loop fastener of Example 1.

Example 3

A conductive hook-and-loop coexistence type fastener was produced in the same manner as in Example 1 except that two rows of loop engagement elements having a multifilament formed of nylon plated with silver were arranged in the warp direction, two rows of hook engagement elements were arranged adjacent thereto in the width direction, two rows of loop engagement elements formed only of multifilament yarn formed of polybutylene terephthalate (305 decitex and 8 filaments) having no multifilament formed of nylon plated with silver were arranged adjacent thereto in the width direction, two rows of hook engagement elements were further arranged adjacent thereto in the width direction, and the arrangement was sequentially repeated.

The conductive performance of the resulting conductive hook-and-loop coexistence type fastener was 7Ω, the conductivity after repeated engagement and release 1,000 times thereof was 22Ω, and the engagement force thereof was equivalent to Example 1. Furthermore, the flexibility, the aesthetics by color tone and dyeing capability, the conductivity, the laundry durability, the electromagnetic wave shielding capability, and the heat generating capability were also excellent as equivalent to the hook-and-loop fastener of Example 1.

The conductive hook-and-loop fastener of Example 3 was the multipath type described above, and was able to be used as a hook-and-loop fastener having plural paths through engagement with the directions thereof aligned with each other.

Example 4

A conductive hook-and-loop coexistence type fastener was produced in the same manner as in Example 1 except that a multifilament yarn formed of nylon plated with silver including 7 filaments having a total decitex of 33 decitex was added through paralleling to the weft yarn including a multifilament yarn formed of core-sheath type composite fibers, and a multifilament formed of nylon plated with silver was not added to the warp yarn existing on one side of the loop engagement elements.

Two plies of the conductive hook-and-loop fasteners were overlapped each other and measured for the electric resistance value in the same manner as in Example 1. As a result, the electric resistance value was 10Ω. The initial engagement force of the hook-and-loop fasteners (in the peeling direction for 100 mm width) was 1.0 N/cm, from which a sufficient engagement force was confirmed. After repeating engagement and release of the hook-and-loop fasteners 1,000 times, the measurement of the electric resistance revealed 50Ω, from which a sufficient conductivity was confirmed even after repeated engagement and release. The engagement force after the repeated engagement and release was 0.92 N/cm, from which there was substantially no decrease of the engagement force even after the repeated engagement and release. Furthermore, the flexibility, the aesthetics by color tone and dyeing capability, the conductivity, the laundry durability, the electromagnetic wave shielding capability, and the heat generating capability were also excellent as equivalent to the hook-and-loop fastener of Example 1.

Example 5

A conductive hook-and-loop coexistence type fastener was produced in the same manner as in Example 1 except that the multifilament yarn formed of nylon plated with silver used in the multifilament yarn for loop engagement elements used in Example 1 was replaced by a conductive multifilament yarn formed of nylon plated with silver including 14 filaments having a total decitex of 66 decitex.

Two plies of the conductive hook-and-loop fasteners were overlapped each other and measured for the electric resistance value in the same manner as in Example 1. As a result, the electric resistance value was 4Ω, which was a better conductivity than Example 1. The initial engagement force of the hook-and-loop fasteners (in the peeling direction for 100 mm width) was 0.95 N/cm, which was a sufficient engagement force as similar to Example 1. After repeating engagement and release of the hook-and-loop fasteners 1,000 times, the measurement of the electric resistance revealed 10Ω, from which an extremely sufficient conductivity was confirmed even after repeated engagement and release. The engagement force after the repeated engagement and release was 0.88 N/cm, from which there was substantially no decrease of the engagement force even after the repeated engagement and release.

Furthermore, the flexibility, the aesthetics by color tone and dyeing capability, the conductivity, the laundry durability, the electromagnetic wave shielding capability, and the heat generating capability were also excellent as equivalent to the hook-and-loop fastener of Example 1. However, the color tone of the loop engagement elements plated with silver was a stronger gray color than Example 1, which caused some problems in the aesthetics in the use in a bright color although there was no problem in the use after dyeing in dark color.

Example 6

A conductive loop type hook-and-loop fastener was produced in the same manner as in Example 1 except that in Example 1, a yarn for loop engagement elements was used instead of the yarn for hook engagement elements. Accordingly, the resulting conductive loop type hook-and-loop fastener had loops over the entire surface thereof. The density of engagement elements of the resulting conductive loop type hook-and-loop fastener was 40 per $cm^2$.

The conductive loop type hook-and-loop fastener and the hook-and-loop coexistence type fastener of Example 1 were overlapped each other and measured for the electric resistance value in the same manner as in Example 1. As a result, the electric resistance value was 5Ω, from which a conductivity equivalent to Example 1 was confirmed. The initial engagement force of the hook-and-loop fasteners (in the peeling direction for 25 mm width) was 0.60 N/cm, from which an engagement force that caused no problem in use was confirmed. After repeating engagement and release of the hook-and-loop fasteners 1,000 times, the measurement of the electric resistance revealed 14Ω, from which a sufficient conductivity was confirmed. The engagement force was 0.55 N/cm. The engagement force was not decreased due to laundry.

As for the heat generating capability of the tape having only loops on the entire surface thereof, the hook-and-loop fastener generated heat at 50 degrees or more under application of electricity of 10 V. It is estimated that the factor thereof is the increase of the conductive yarns inserted.

REFERENCE SIGN LIST

1: Base cloth
2: Hook engagement element
3: Loop engagement element
4: Warp direction
5: Weft direction
$a_1$: Distance between loop engagement elements adjacent to each other
$a_2$: Distance between loop engagement element rows with hook engagement element row intervening therebetween
b: Height of loop engagement element

The invention claimed is:

1. A conductive hook-and-loop fastener comprising:
a base cloth comprising a woven fabric, the base cloth having on one surface a plurality of loop engagement elements comprising a multifilament yarn, the multifilament yarn comprising a conductive filament, wherein the multifilament yarn is inwoven in a warp direction of the woven fabric; and
a plurality of hook engagement elements comprising a monofilament yarn,
wherein the plurality of hook engagement elements and the plurality of loop engagement elements coexist on one surface of the base cloth.

2. The conductive hook-and-loop fastener of claim 1, wherein the plurality of loop engagement elements comprises a non-conductive multifilament yarn and a conductive multifilament yarn.

3. The conductive hook-and-loop fastener of claim 1, wherein at least one yarn on both right and left sides of the multifilament yarn comprises a conductive filament.

4. The conductive hook-and-loop fastener of claim 1, wherein the woven fabric comprises a weft yarn,
wherein the weft yarn comprises a heat fusible multifilament yarn, and
wherein the plurality of loop engagement elements comprises roots that are fixed to the woven fabric through fusion of the heat fusible multifilament yarn.

5. The conductive hook-and-loop fastener of claim 1, wherein the woven fabric comprises a weft yarn, and
wherein the weft yarn comprises a conductive filament.

6. The conductive hook-and-loop fastener of claim 1, wherein the conductive filament is exposed on a back surface of the hook-and-loop fastener, and
wherein the plurality of loop engagement elements and the back surface of the hook-and-loop fastener are electrically conducted to each other.

7. The conductive hook-and-loop fastener of claim 1, wherein the plurality of loop engagement elements are formed by napping.

8. The conductive hook-and-loop fastener of claim 1, wherein the monofilament yarn is a non-conductive monofilament yarn.

9. The conductive hook-and-loop fastener of claim 1, wherein the woven fabric comprises a weft yarn,
wherein the weft yarn comprises a heat fusible multifilament yarn, and
wherein the plurality of hook engagement elements comprises roots that are fixed to the woven fabric through fusion of the heat fusible multifilament yarn.

10. The conductive hook-and-loop fastener of claim 1, wherein the plurality of loop engagement elements are arranged in two rows in a warp direction, each row on opposite sides of the plurality of hook engagement elements arranged in a row, and
wherein a distance between the loop engagement element rows with the hook engagement element row intervening therebetween is twice or more a height of the loop engagement elements.

11. An electronic component comprising the conductive hook-and-loop fastener of claim 1.

12. A heat generating sheet comprising the conductive hook-and-loop fastener of claim 1.

13. An electromagnetic wave shielding sheet comprising the conductive hook-and-loop fastener of claim 1.

14. A clothing or a shoe comprising the electronic component of claim 11.

15. A combination of conductive hook-and-loop fasteners comprising two plies of the conductive hook-and-loop fasteners of claim 1 that are engaged through engagement element surfaces thereof,
wherein at least one of the conductive hook-and-loop fasteners is a hook-and-loop coexistence type fastener, and
wherein a back surface of one of the hook-and-loop fasteners and a back surface of the other of the hook-and-loop fasteners are electrically conducted to each other.

16. A method for producing a conductive hook-and-loop fastener, comprising:
preparing a warp yarn comprising a multifilament yarn, a weft yarn comprising a heat fusible multifilament yarn, and a yarn for loop engagement elements comprising a conductive filament;
weaving a loop woven fabric having the yarn for loop engagement elements inwoven in a warp direction and having plural loops comprising the yarn for loop engagement elements rising up from a surface; and
fusing the heat fusible multifilament yarn by heating the loop woven fabric, so as to fix roots of the loops to the woven fabric and to fix a shape of the loops.

17. A method for producing a conductive hook-and-loop coexistence type fastener, comprising:
preparing a warp yarn comprising a multifilament yarn, a weft yarn comprising a heat fusible multifilament yarn, a yarn for hook engagement elements comprising a monofilament yarn, and a yarn for loop engagement elements comprising a conductive filament;

weaving a loop woven fabric having the yarn for hook engagement elements and the yarn for loop engagement elements inwoven in a warp direction and having plural loops comprising the yarn for hook engagement elements and the yarn for loop engagement elements rising up from a surface;

fusing the heat fusible multifilament yarn by heating the loop woven fabric, so as to fix roots of the loops to the woven fabric and to fix a shape of the loops; and cutting roots on one side of the loops comprising the monofilament yarn to make hook engagement elements from the loops.

* * * * *